US005553709A

United States Patent [19]

Wharton, Jr. et al.

[11] Patent Number: 5,553,709

[45] Date of Patent: Sep. 10, 1996

[54] CONTAINER ASSEMBLY FOR PLASTIC BOTTLES AND THE LIKE

[75] Inventors: Paul B. Wharton, Jr., Lake Forest; James M. Wharton, Prospect Heights, both of Ill.

[73] Assignee: Kinetics Container Corporation, Des Plaines, Ill.

[21] Appl. No.: 381,331

[22] Filed: Dec. 21, 1994

[51] Int. Cl.[6] ..... B65D 85/20

[52] U.S. Cl. ..... 206/446; 206/427; 206/196; 206/814; 229/120.28

[58] Field of Search ..... 206/160, 194, 206/196, 193, 446, 427, 814; 229/120.28

[56] References Cited

U.S. PATENT DOCUMENTS

| | | | |
|---|---|---|---|
| 1,983,418 | 12/1934 | Thurmer | 206/427 |
| 2,923,402 | 2/1960 | Baker | 206/446 |
| 3,016,182 | 1/1962 | Chidsey, Jr. | 206/196 |
| 4,418,818 | 12/1983 | Stone | 206/196 |
| 5,372,299 | 12/1994 | Edgerton, Jr. et al. | 206/427 |

FOREIGN PATENT DOCUMENTS

| | | | |
|---|---|---|---|
| 558906 | 1/1944 | United Kingdom | 229/120.28 |

*Primary Examiner*—David T. Fidei
*Attorney, Agent, or Firm*—John R. Hoffman

[57] ABSTRACT

A container assembly is adapted for holding at least one plastic bottle which includes a capped top and a side handle with an upwardly facing flat area adjacent the handle. The assembly includes a container having a top wall, a bottom wall and side walls spanning the top and bottom walls. The side walls have a height greater than the height of the bottle so that the capped top of the bottle is spaced from the top wall when the bottle rests upright on the bottom wall. A bracing structure is positioned within the container in abutting interengagement between the flat area of the bottle and the top wall of the container to maintain the capped top of the bottle spaced from the top wall of the container.

12 Claims, 5 Drawing Sheets

CONTAINER ASSEMBLY FOR PLASTIC BOTTLES AND THE LIKE

FIELD OF THE INVENTION

This invention generally relates to the art of container assemblies, such as corrugated paper board containers, and, particularly, to a container assembly for holding plastic bottles.

BACKGROUND OF THE INVENTION

A wide variety of materials ranging from distilled water to acids are carried during manufacture, shipping and use in plastic bottles (e.g. gallon bottles). The shape of many of these bottles has become an industry standard wherein the bottles include a capped top and a side handle with upwardly facing flat areas adjacent to and on opposite sides of the handle. The caps for the bottles may be two-part safety caps which require downward pressure in combination with rotary motion to remove the cap from the bottle.

One of the principal problems in using such bottles has been in the area of packaging the filled bottles for shipment and ultimate use. Typical packaging has been conventional container assemblies fabricated of corrugated paper board material. However, regulations have been enacted to require that the container assemblies withstand certain impact criteria before bottles filled with toxic or hazardous material, such as anti-freeze, bleach, acids and the like, can be shipped.

In particular, as of Oct. 1, 1994, United Nations Regulations require that a container assembly for holding and shipping plastic bottles be capable of withstanding a vertical drop of forty seven and one-fourth inches without the bottle cap breaking or the bottle splitting. This criterion applies equally when safety caps are used, even though safety caps have a tendency to break more easily than conventional screw-on one-piece metal or plastic caps. These criteria also must be met in the event that the contents of the bottles become frozen, such as during shipment in high altitude aircraft.

Heretofore, most prior art attempts have failed in meeting the above regulations. Their failures have been primarily attributable to their inability to isolate the capped tops of the bottles from impact with surrounding portions of the container assembly.

Prior art approaches to protecting the bottles within the container assemblies most often include providing inserts within the assemblies for covering the capped tops of the bottles. These inserts not only fail to isolate the capped tops of the bottles, but the inserts cause other problems as well. For instance, it may be desirable to fill the bottles while in the container assembly. Such inserts considerably reduce the efficiency of such mass production. Such inserts also have been found to interfere with container sealing equipment, again reducing the efficiency of mass production.

The present invention is directed to solving the above problems by providing a container assembly for bottles, such as the plastic bottles described above, wherein the capped tops of the bottles are completely isolated from surrounding structure of the container assembly, and wherein the capped tops of the bottles are maintained in isolation during regulated impact conditions.

SUMMARY OF THE INVENTION

An object, therefore, of the invention is to provide a new and improved container assembly for holding capped bottles.

Another object of the invention is to provide a container assembly for holding at least one plastic bottle which includes a capped top and a side handle with an upwardly facing flat area adjacent the handle.

In the exemplary embodiment of the invention, the container assembly includes a container having top wall means, bottom wall means and side wall means spanning the top and bottom wall means. The side wall means have a height greater than the height of the bottle so that the capped top of the bottle is spaced from the top wall means when the bottle rests upright on the bottom wall means. A bracing structure is positioned within the container in abutting interengagement between the flat area of the bottle and the top wall means of the container to maintain the capped top of the bottle spaced from the top wall means of the container.

As disclosed herein, the bracing structure includes a substantially rigid planar wall in edge engagement with the flat area of the bottle and the top wall means of the container. The planar wall includes a slot for accommodating the side handle of the bottle.

In the preferred embodiments, the container and the bracing structure are fabricated of corrugated paper board material. The planar wall of the bracing structure has the elongated corrugations of the paper board running in a direction between the flat area of the bottle and the top wall means of the container. Preferably, the planar wall of the bracing structure has a plurality of thicknesses of the corrugated paper board material.

Still further, the invention is disclosed herein with the container assembly adapted for holding a plurality of the plastic bottles arranged in a pair of rows, with the side handles of the bottles facing inwardly toward a center-line extending generally parallel to the rows. The bracing structure is elongated and extends generally along the center-line within the container. The bracing structure is generally U-shaped in cross-section forming a pair of leg portions joined by a bight portion. The leg portions define a pair of generally parallel planar walls in edge engagement between the flat areas of the bottles in the two rows and the top wall means of the container. A plurality of slots are provided at the junctures between the leg portions and the bight portion of the U-shaped bracing structure for accommodating the side handles of the bottles facing inwardly toward the center-line of the container.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
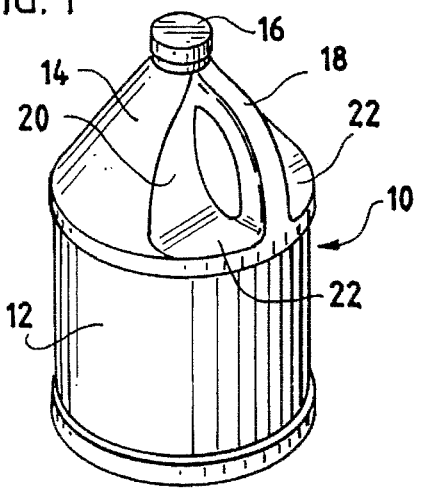
FIG. 1 is a perspective view of a bottle applicable for use within the container assembly of the invention.

Referring to the drawings in greater detail, and first to FIG. 1, the container assemblies disclosed herein according to the invention are adapted for holding one or more plastic bottles, generally designated 10 in FIG. 1. The shape or configuration of bottle 10 has become an industry standard for holding and shipping a wide variety of materials. The bottle typically has a cylindrical body 12 (although rectangular bottles are contemplated) having a frusto-conical top 14 terminating in a cap 16 threaded or screwed onto the top of the bottle. A side handle 18 projects from a recessed area 20 at the top of the bottle, and a pair of upwardly facing flat areas 22 are formed at the base of the handle on opposite sides of the handle. Cap 16 may be a conventional one-piece plastic or metal cap threaded onto the top of the bottle, or the cap may be a "safety" cap conventionally fabricated of two parts whereby downward pressure must be applied in conjunction with rotary motion in order to remove the cap. The bottle conventionally is molded or extruded of plastic material.

Figure 2:
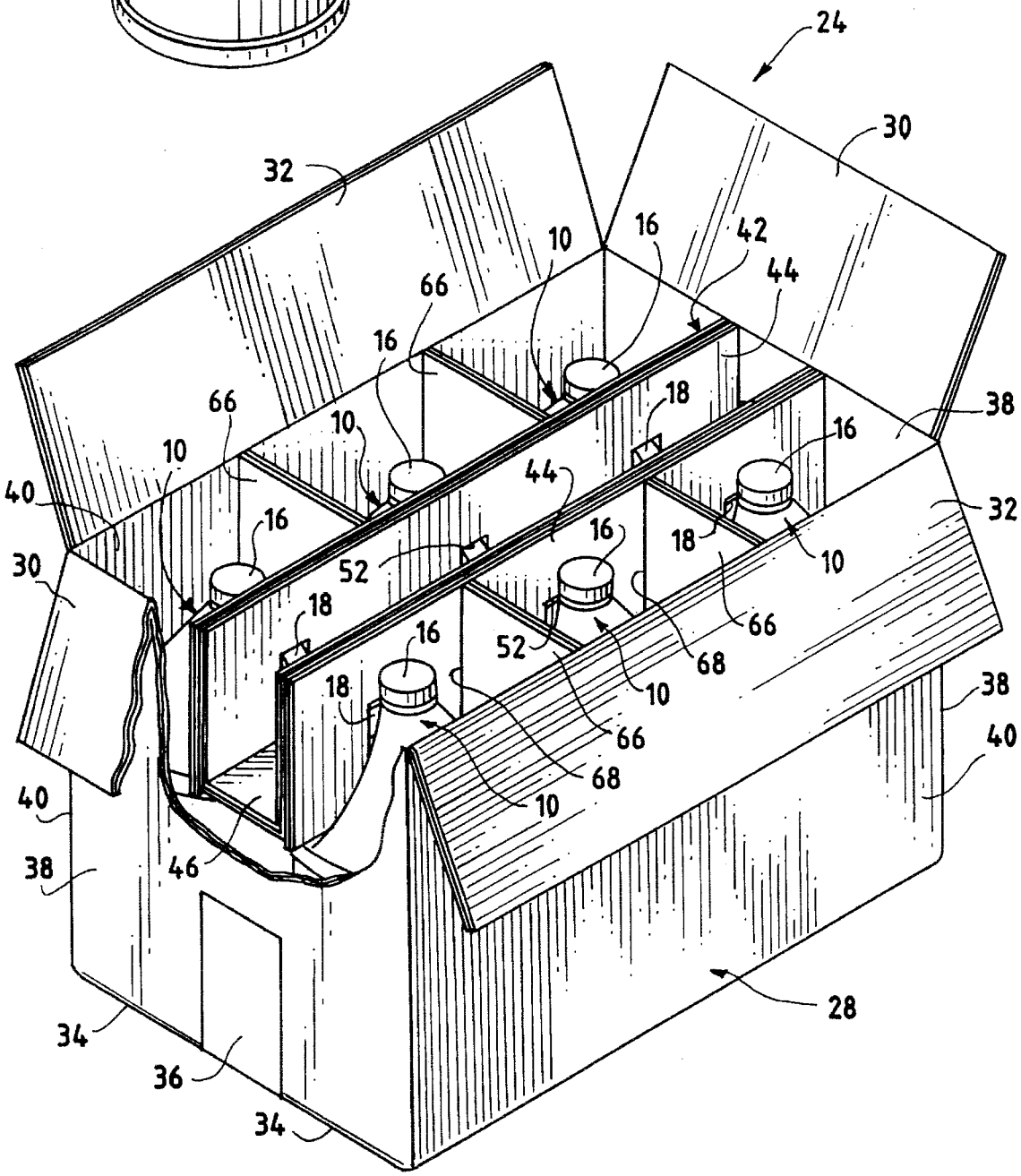
FIG. 2 is a perspective view of the container assembly of the invention for holding six bottles in two rows, the container of the assembly being cut-away to show the bracing structure therewithin.
Figure 3:
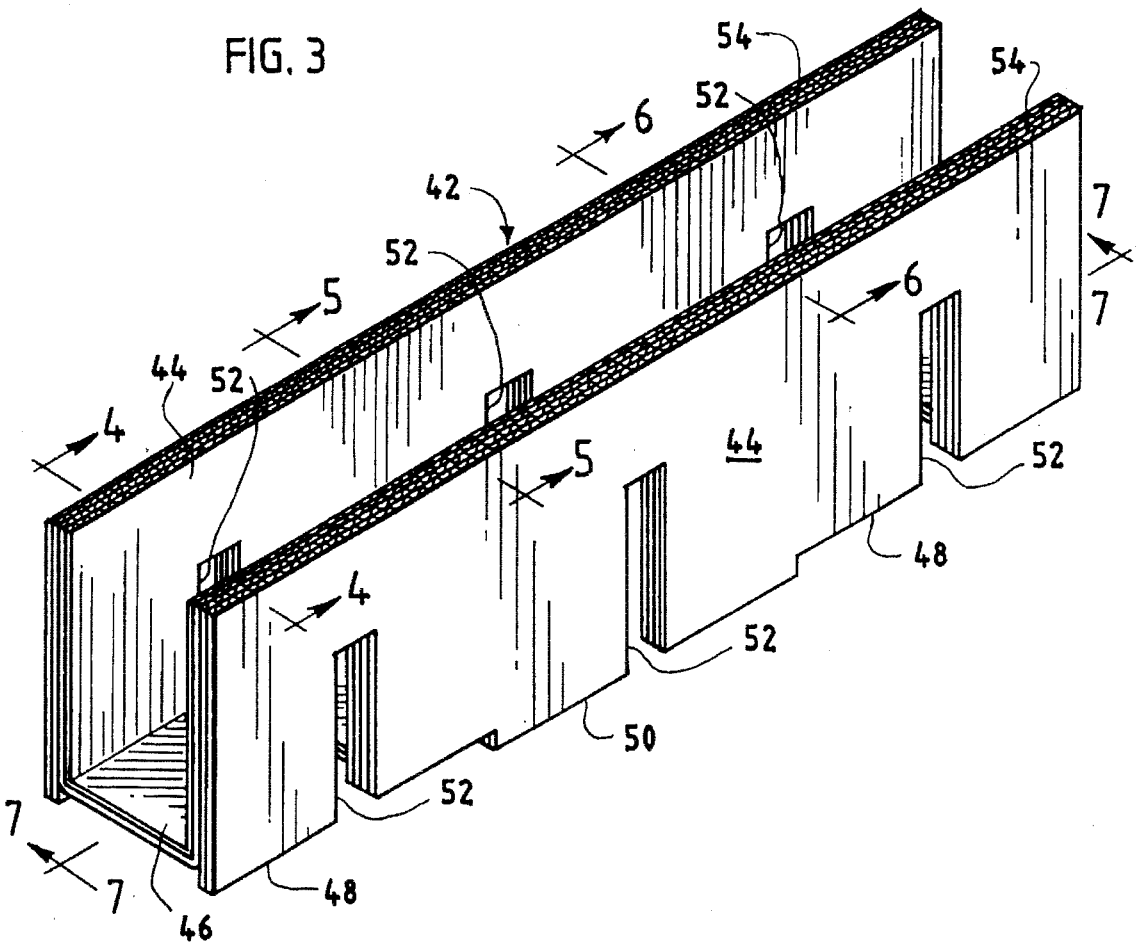
FIG. 3 is a perspective view, on an enlarged scale, of the bracing structure within the container of FIG. 2.
Figure 13:
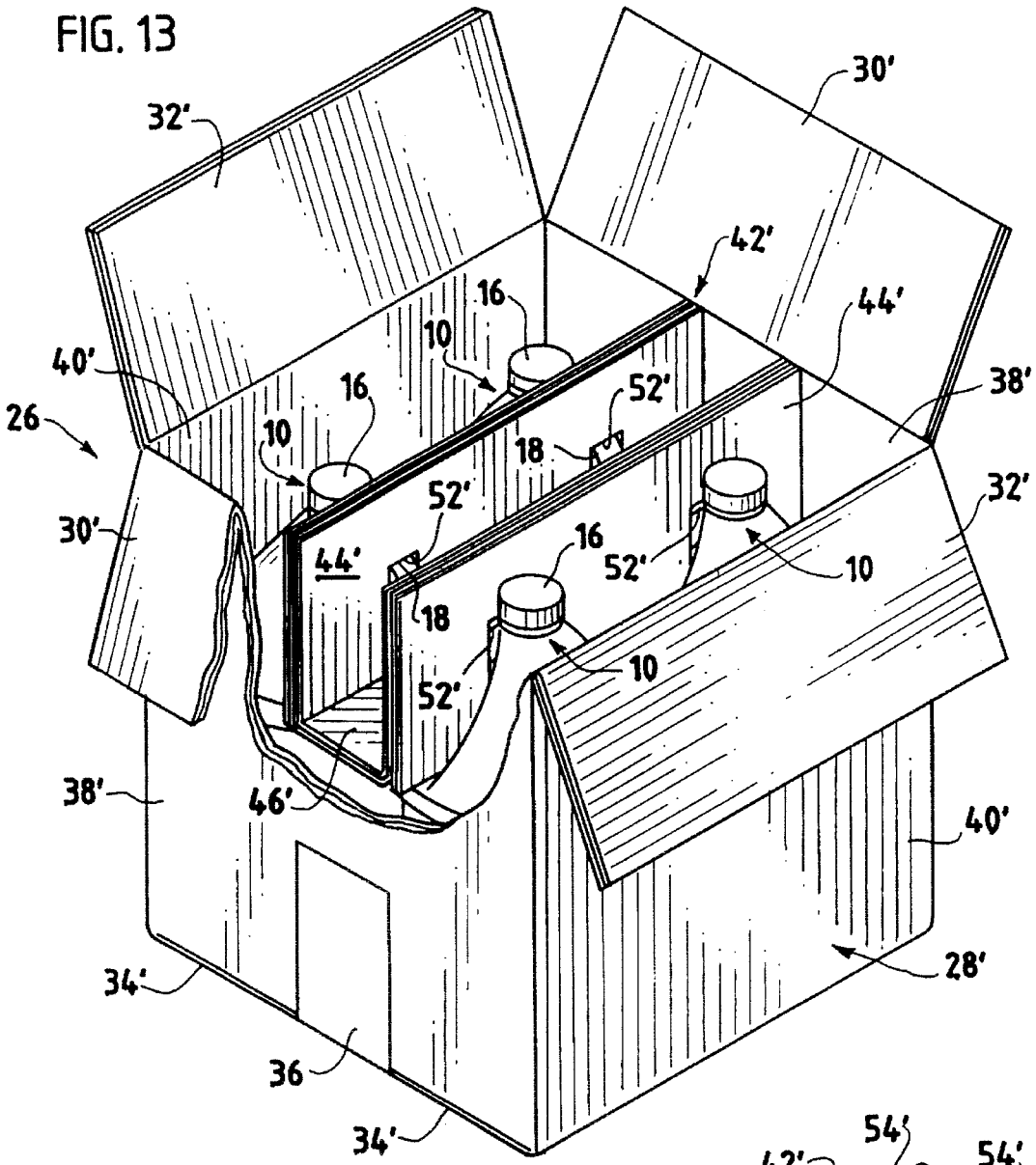
FIG. 13 is a perspective view of a container assembly similar to that of FIG. 2, but for holding four bottles rather than six bottles.

The invention herein is embodied in a container assembly, generally designated 24 in FIG. 2 and generally designated 26 in FIG. 13. Container assembly 24 is designed for holding six bottles 10, whereas container 26 in FIG. 3 is designed for holding four bottles 10. Regardless, both container assemblies 24 are capable of holding the bottles in two rows with side handles 18 of the bottles facing inwardly toward a center-line extending generally parallel to the rows.

Figure 14:
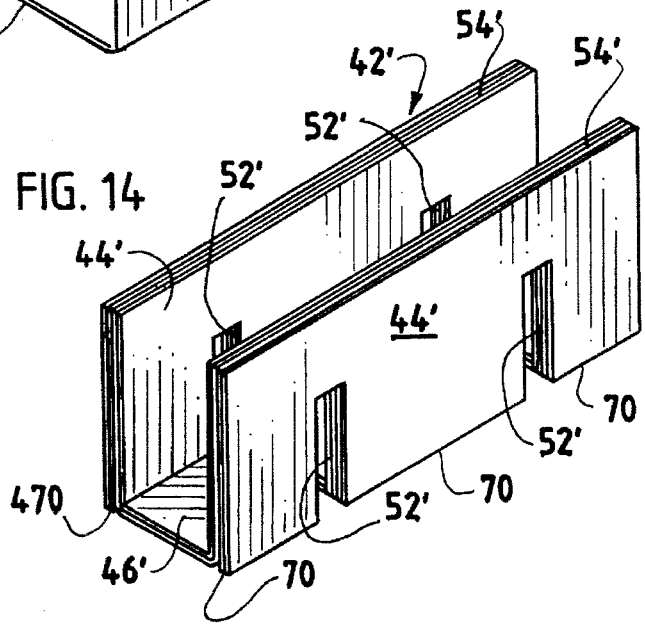
FIG. 14 is a perspective view of the bracing structure for use within the four-bottle container assembly of FIG. 13.

FIGS. 2–12 relate to container assembly 24 shown in FIG. 2, and FIGS. 13 and 14 relate to container assembly 26 shown in FIG. 13. Container assembly 24 first will be described below.

In particular, container assembly 24 (FIG. 2) includes a container, generally designated 28, which has top wall means including a pair of end flaps 30 and a pair of side flaps 32. The container has bottom wall means which similarly include a pair of end flaps (not visible in FIG. 2) and a pair of side flaps 34. The bottom wall means is closed and secured by tape 36. Container 24 further has side wall means spanning the top and bottom wall means, the side wall means including a pair of end walls 38 and a pair of side walls 40. The entire container 28 is fabricated of corrugated paper board material of at least one thickness. Container 28 is shown herein to be of a double thickness of the corrugated paper board material.

Referring to FIG. 3 in conjunction with FIG. 2, container assembly 24 includes an elongated bracing structure, generally designated 42, which extends generally along the center-line of the container between the two rows of bottles 10. The bracing structure is generally U-shaped in cross-section to form a pair of leg portions 44 joined by a lower bight portion 46. The leg portions define substantially rigid vertical planar walls within container 28. In fact, it can be seen clearly in FIG. 3 that rigid planar walls 44 are of four thicknesses of corrugated paper board material in the exemplary embodiment of the invention. These substantially rigid planar walls are provided for abuttingly interengaging between flat areas 22 of bottles 10 and the top wall means of the container to maintain the capped tops of the bottles spaced from the top wall means of the container as will be more apparent hereinafter.

Figure 4:
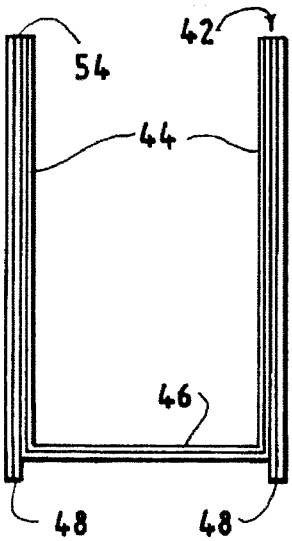
FIG. 4 is a vertical section taken generally along line 4—4 of FIG. 3.
Figure 5:
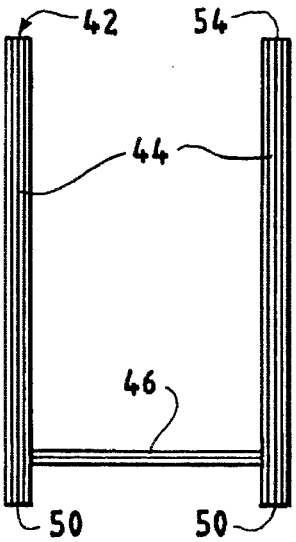
FIG. 5 is a vertical section taken generally along line 5—5 of FIG. 3.
Figure 6:
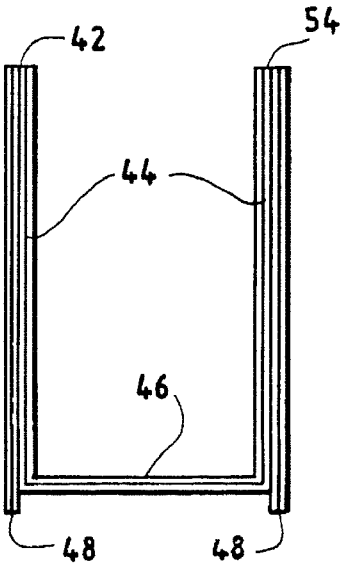
FIG. 6 is a vertical section taken generally along line 6—6 of FIG. 3.
Figure 7:
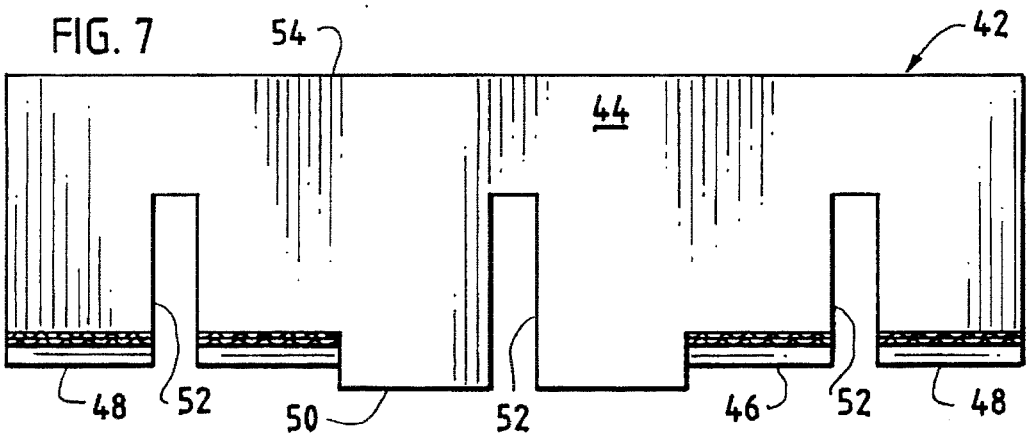
FIG. 7 is a vertical section taken generally along line 7—7 of FIG. 3.

Referring to FIGS. 4–6 in conjunction with FIGS. 2 and 3, it can be seen that the outer two thicknesses of the corrugated paper board material of planar walls 44 project downwardly below bight portion 46 to define projecting edges 48 in FIGS. 4 and 6 and projecting edges 50 in FIG. 5. These edges abuttingly engage flat areas 22 of bottles 10. Edges 48 extend below bight portion 46 approximately one eighth inch and edges 50 extend below bight portion 46 approximately one fourth inch to provide crushable edges before the flat bight portion engages flat areas 22 and the full four-thickness of planar walls 44 prevent any further crushing. This provides sort of a cushioning effect for the bottles. In comparing FIGS. 4–6 with FIG. 3, it can be seen that center edge 50 projects further below bight portion 46 than end edges 48. This variance is to accommodate the uneven surface within container 28 on which the bottles rest. Specifically, the four end-most bottles in FIG. 2 rest on top of the end flaps of the bottom wall means and, therefore, will be elevated versus the two center-most bottles. Therefore, end edges 48 are elevated relative to center edge 50 to accommodate the different heights of the bottles within the container.

A plurality of slots 52 are provided at the junctures between leg portions or planar walls 44 and bight portion 46 of bracing structure 42 for accommodating side handles 18 of bottles 10 as seen best in FIG. 2.

Figure 8:
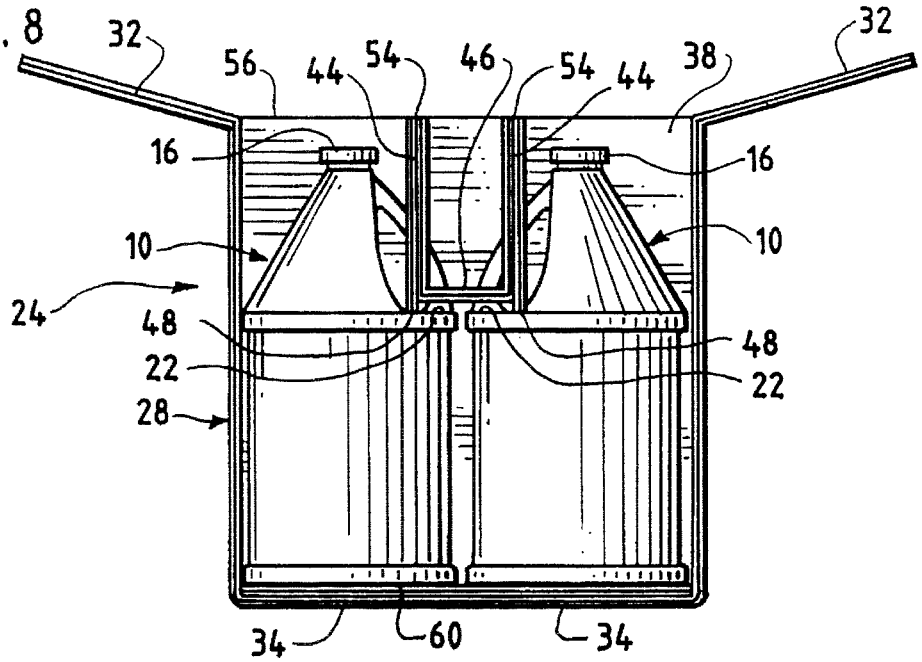
FIG. 8 is an end elevational view of the container assembly looking toward the left-hand end of FIG. 2, with the side wall removed to show the two bottles at the end of the container assembly.
Figure 9:
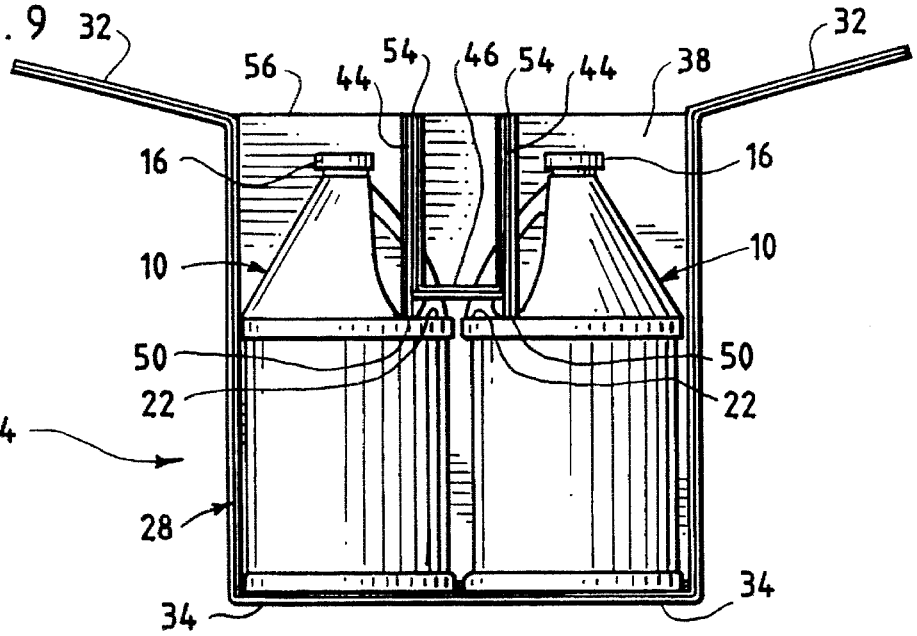
FIG. 9 is a view similar to that of FIG. 8, but showing the two center bottles within the container assembly.

FIGS. 8 and 9 best show how bracing structure 42 abuttingly interengages between flat areas 22 of bottles 10 and the top wall means (flaps 30 and 32) of container 28. In particular, substantially rigid planar walls 44 of the bracing structure engage flat areas 22 of the bottles at the bottom edges 48 and 50 of the walls. The top edges 54 of the walls are even or flush with the top 56 of the side wall means of the container. Therefore, when the top wall means (flaps 30 and 32) of the container are closed and secured, top edges 54 of planar walls 44 will abut against the top wall means of the container and isolate the capped tops 16 of the bottles in open space. In other words, it can be seen in FIGS. 8 and 9 that caps 16 of bottles 10 are spaced from the top of the container. During impact loads, such as dropping the entire container assembly with the bottles therein, bracing structure 42, and particularly substantially rigid planar walls 44 of the bracing structure, prevent the capped tops of the bottles from engaging any portion of the container assembly whatsoever. Therefore, the capped tops of the bottles are isolated from any impact forces.

FIGS. 8 and 9 also show how the different heights of edges 48 and 50 of the bracing structure accommodate or compensate for the different elevations of the bottles within the container assembly. More particularly, FIG. 8 shows two of the end-most bottles resting on top of both the end flaps 60 and the side flaps 34 of the bottom wall means of container 28. Therefore, the end-most bottles are elevated by the end flaps 60 of the bottom wall means. Consequently, edges 48 are shorter than edges 50 shown in FIG. 9. Bottles 10 in FIG. 9 represent the two center-most bottles in the array of FIG. 2. It can be seen in FIG. 9 that these bottles rest only on side flaps 34 of the bottom wall means of the container. Therefore, edges 50 are longer for engaging flat areas 22 of the bottles to maintain a rigid support between the flat areas and the top wall means of the container when the container is in closed condition.

Figure 10:
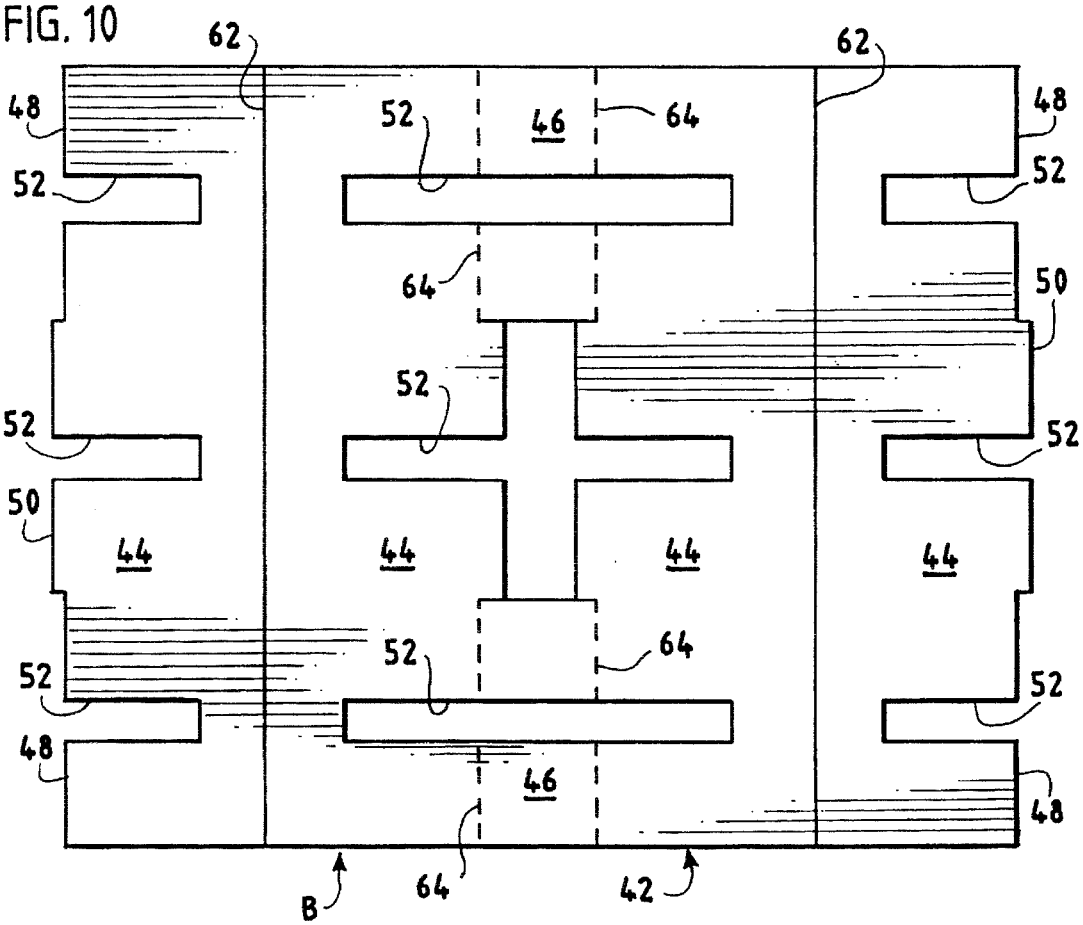
FIG. 10 is a plan view of a paper board blank from which the bracing structure is formed.

FIG. 10 shows a blank "B" from which bracing structure 42 (FIG. 3) is formed. Edges 48 and 50 and slots 42 are represented by like numerals in FIG. 10 corresponding to the above description of those components in relation to FIGS. 2–9. Similarly, areas of blank "B" corresponding to side walls 44 and bight portion 46 are represented by corresponding reference numerals. In fabrication, elongated lines 62 are cut entirely through the blank except for the bottom-most sheet of paper which is maintained uncut to hold the blank together. The bottom of the blank is cut as indicated at dotted lines 64 so that the blank can be folded upwardly thereat.

Figure 11:
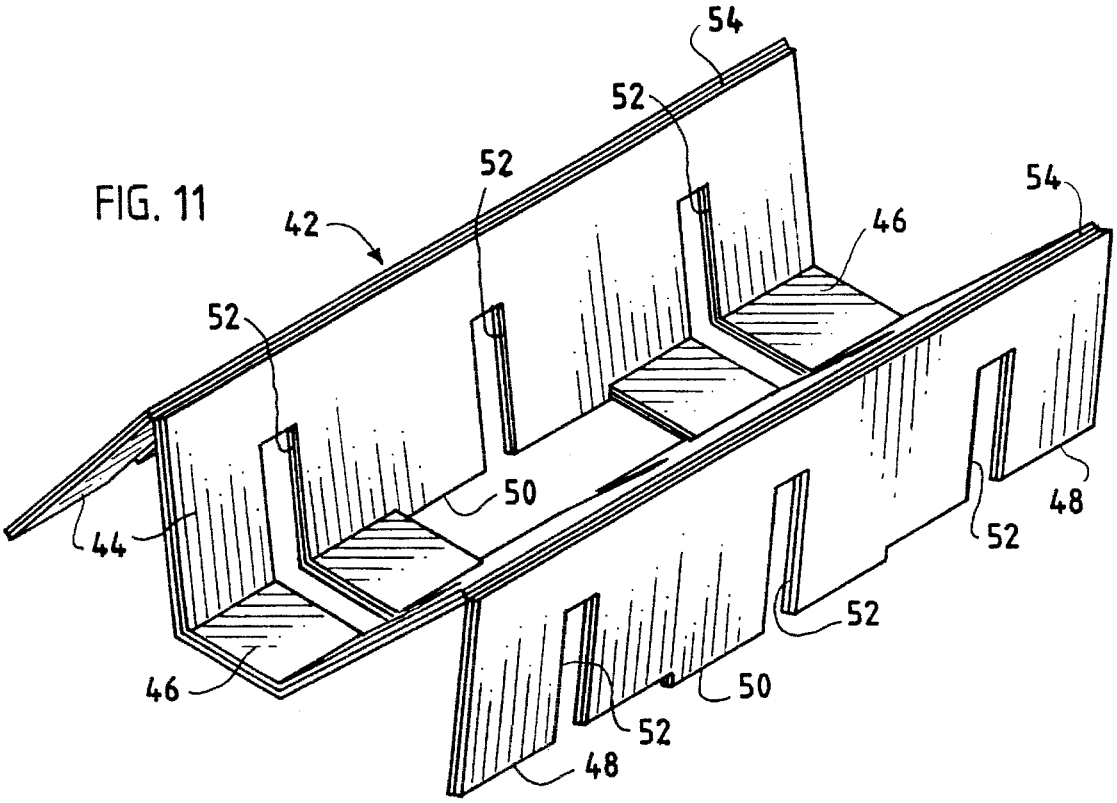
FIG. 11 is a perspective view of the bracing structure in an intermediate folding stage, i.e. between the blank of FIG. 10 and the final configuration of FIG. 3.

With the fold liens cut at 62 and 64 in blank "B" (FIG. 10), the blank is folded as shown in FIG. 11 until the blank achieves its final configuration as shown in FIG. 3 to define the U-shaped bracing structure 42.

Figure 12:
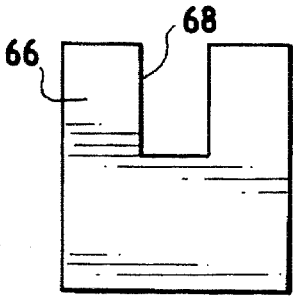
FIG. 12 is an elevational view, on a reduced scale, of one of the divider partitions in the container assembly of FIG. 2.

FIG. 12 simply shows, on a reduced scale, that generally planar partitions 66 can be used to span side walls 44 of container 28 in FIG. 2 in order to separate the bottles in the two rows thereof. Partitions 66 have cutouts 68 to accommodate U-shaped bracing structure 42.

FIGS. 13 and 14 show container assembly 26 which, as stated above, is designed to hold four bottles 10 versus the six-bottle container assembly 24 of the FIG. 2.

In FIGS. 13 and 14, "primed" reference numerals have been applied to correspond to like components described above in relation to the six-bottle container assembly of FIGS. 2–11. In particular, container assembly 26 includes a container, generally designated 28', having side walls 38' and 40' with top flaps 30' and 32' as well as bottom flaps 34'. Bottles 10 are identical and include top caps 16 and side handles 18. Bracing structure 42' again is generally U-shaped and includes substantially rigid planar walls 44' joined by a bight portion 46'. Slots 52' are provided in planar walls 44' for accommodating the handles of the bottles.

As seen in FIG. 14, edges 70 project downwardly below bight portion 46' of bracing structure 42' for engaging flat areas 22 of bottles 10. Edges 70 all are of equal lengths versus the varying lengths of edges 48 and 50 in the bracing structure 42 of the six-bottle container assembly 24, because the bottom wall means of the four-bottle container assembly 26 has no uneven areas since the bottom flaps of the four-bottle container assembly cover the entire bottom of container 28'.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A container assembly for holding at least one plastic bottle which includes a capped top and a side handle with an upwardly facing flat area adjacent the handle, comprising:

a container having a top wall structure, a bottom wall structure and a side wall structure spanning the top and bottom wall structures, the side wall structure having a height greater than the height of the bottle so that the capped top of the bottle is spaced from the top wall structure when the bottle rests upright on the bottom wall structure; and a bracing structure within the container in abutting interengagement between the flat area of the bottle and the top wall structure of the container to maintain the capped top of the bottle spaced from the top wall structure of the container, said bracing structure including a substantially rigid planar wall in edge engagement with the flat area of the bottle and the top wall structure said planar wall including a slot for accommodating the side handle of the bottle, and said container and said bracing structure being fabricated of corrugated paper board material.

2. The container assembly of claim 1 wherein said container and said bracing structure are fabricated of corrugated paper board material.

3. The container assembly of claim 1 wherein said planar wall has elongated corrugations running in a direction between the flat area of the bottle and the top wall structure of the container.

4. The container assembly of claim 1 wherein said planar wall of the bracing structure has a plurality of thicknesses of the corrugated paper board material.

5. A container assembly for holding a plurality of plastic bottles each including a capped top and a side handle with an upwardly facing flat area adjacent the handle, the bottles being arranged in a pair of rows with the side handles of the bottles facing inwardly toward a center-line extending generally parallel to the rows, comprising:

a container having a top wall structure, a bottom wall structure and a side wall structure, the side wall structure having a height greater than the heights of the bottles so that the capped tops of the bottles are spaced from the top wall structure when the bottles rest upright on the bottom wall structure; and an elongated bracing structure extending generally along said center-line within the container in abutting interengagement between the flat areas of the bottles and the top wall structure of the container to maintain the capped tops of the bottles spaced from the top wall structure of the container, said bracing structure including substantially rigid planar walls in edge engagement between the flat areas of the bottles and the top wall structure of the container, said planar walls including slots for accommodating the side handles of the bottles, and said container and said bracing structure being fabricated of corrugated paper board material.

6. The container assembly of claim 5 wherein said container and said bracing structure are fabricated of corrugated paper board material.

7. The container assembly of claim 5 wherein said planar walls have elongated corrugations running in a direction between the flat areas of the bottles and the top wall structure of the container.

8. The container assembly of claim 5 wherein said planar walls of the bracing structure have a plurality of thicknesses of the corrugated paper board material.

9. The container assembly of claim 5 wherein said bracing structure is generally U-shaped in cross-section forming a pair of leg portions joined by a bight portion, the leg portions defining said planar walls.

10. The container assembly of claim 9 wherein the bracing structure includes a plurality of slots at the junctures between the leg portions and the bight portion for accommodating the side handles of the bottles.

11. The container assembly of claim 5, including partitions separating the bottles in the rows thereof, the partitions including notches for accommodating the elongated bracing structure.

12. A container assembly for holding a plurality of plastic bottles each including a capped top and a side handle with an upwardly facing flat area adjacent the handle, the bottles being arranged in a pair of rows with the side handles of the bottles facing inwardly toward a center-line extending generally parallel to the rows, comprising:

a container having a top wall structure, a bottom wall structure and a side wall structure, the side wall structure having a height greater than the heights of the bottles so that the capped tops of the bottles are spaced from the top wall structure when the bottles rest upright on the bottom wall structure, the bottom wall means of said container including flaps which create an uneven surface causing the bottles resting thereon to be spaced at different heights relative to the top wall structure of the container; and an elongated bracing structure extending generally along said center-line within the container in abutting interengagement between the flat areas of the bottles and the top wall structure of the container to maintain the capped tops of the bottles spaced from the top wall structure of the container, said bracing structure including substantially rigid planar walls in engagement between the flat areas of the bottles and the top wall structure of the container, and said planar walls having uneven edges to compensate for the uneven surface of the bottom wall structure of the container.

* * * * *